US008009008B2

(12) United States Patent
MacLennan

(10) Patent No.: US 8,009,008 B2
(45) Date of Patent: Aug. 30, 2011

(54) INDUCTOR MOUNTING, TEMPERATURE CONTROL, AND FILTERING METHOD AND APPARATUS

(75) Inventor: Grant MacLennan, Scottsdale, AZ (US)

(73) Assignee: CTM Magnetics, Inc., Tempe, AZ (US)

( * ) Notice: Subject to any disclaimer, the term of this patent is extended or adjusted under 35 U.S.C. 154(b) by 455 days.

(21) Appl. No.: 12/197,034

(22) Filed: Aug. 22, 2008

(65) Prior Publication Data

US 2009/0045898 A1 Feb. 19, 2009

Related U.S. Application Data

(63) Continuation-in-part of application No. 11/156,080, filed on Jun. 17, 2005, now Pat. No. 7,471,181, and a continuation-in-part of application No. 12/098,880, filed on Apr. 7, 2008.

(60) Provisional application No. 60/580,922, filed on Jun. 17, 2004, provisional application No. 60/910,333, filed on Apr. 5, 2007, provisional application No. 60/957,371, filed on Aug. 22, 2007.

(51) Int. Cl.
*H01F 27/26* (2006.01)

(52) U.S. Cl. ..... 336/210

(58) Field of Classification Search ..... 336/65, 336/210, 212, 225, 229
See application file for complete search history.

(56) References Cited

U.S. PATENT DOCUMENTS

| | | | | |
|---|---|---|---|---|
| 3,374,452 | A | 3/1968 | Judd | |
| 3,377,582 | A | 4/1968 | Rogers | |
| 3,668,589 | A | 6/1972 | Wilkinson | |
| 4,393,435 | A | 7/1983 | Petrina | |
| 4,547,713 | A | 10/1985 | Langley et al. | |
| 4,639,626 | A | 1/1987 | McGee | |
| 4,710,667 | A | 12/1987 | Whiteley | |
| 4,806,895 | A * | 2/1989 | Petrow | 336/65 |
| 5,256,211 | A | 10/1993 | Silgailis et al. | |
| 5,307,043 | A * | 4/1994 | Dvorak et al. | 336/174 |
| 5,444,229 | A | 8/1995 | Rudolph et al. | |
| 5,481,238 | A | 1/1996 | Carsten et al. | |
| 5,543,674 | A | 8/1996 | Koehler | |
| 5,543,773 | A | 8/1996 | Evans et al. | |
| 5,868,123 | A | 2/1999 | Hasegawa et al. | |
| 6,154,109 | A | 11/2000 | Gold | |
| 6,166,472 | A | 12/2000 | Pinkerton et al. | |
| 6,262,651 | B1 * | 7/2001 | Miyamoto et al. | 336/192 |
| 6,648,990 | B2 | 11/2003 | Yoshizawa | |

(Continued)

FOREIGN PATENT DOCUMENTS

DE 3047603 A * 7/1982

*Primary Examiner* — Tuyen Nguyen

(74) *Attorney, Agent, or Firm* — The Noblitt Group, PLLC

(57) ABSTRACT

Methods and apparatus according to various aspects of the present invention may be implemented in conjunction with a inductor mount mounting to a mounting surface. The inductor mount may comprise an inductor having a center opening, and a surface area encompassing all of a front face, a back face, an inner surface about the center opening, and an outer edge concentric about the center opening. The inductor mount may further include mounting hardware holding the outer edge of then inductor to the mounting surface. A cooling element moves air into contact with the front face, through the center opening, and around the outer edge of the inductor. In various embodiments, the mounting hardware contacts less that ten percent of the surface area of the inductor.

19 Claims, 4 Drawing Sheets

U.S. PATENT DOCUMENTS 6,690,257 B2 * 2/2004 Kobayashi et al. ..... 336/229
6,897,718 B2 5/2005 Yoshida et al.
7,471,181 B1 12/2008 MacLennan
7,479,865 B2 * 1/2009 Feist et al. ..... 336/229
7,498,916 B2 * 3/2009 Feist et al. ..... 336/65
7,855,629 B2 12/2010 MacLennan
2009/0045898 A1 2/2009 MacLennan
2009/0267720 A1 10/2009 MacLennan et al.

* cited by examiner

INDUCTOR MOUNTING, TEMPERATURE CONTROL, AND FILTERING METHOD AND APPARATUS

CROSS-REFERENCES TO RELATED APPLICATIONS

This application:

is a continuation-in-part of U.S. patent application Ser. No. 11/156,080, filed Jun. 17, 2005, now U.S. Pat. No. 7,471,181 which claims benefit of U.S. provisional patent application No. 60/580,922 filed Jun. 17, 2004;

is a continuation-in-part of U.S. patent application Ser. No. 12/098,880, filed Apr. 7, 2008, which claims benefit of U.S. provisional patent application No. 60/910,333 filed Apr. 5, 2007; and claims benefit of U.S. patent application No. 60/957,371 filed Aug. 22, 2007, all of which are incorporated herein in their entirety by this reference thereto.

BACKGROUND OF THE INVENTION

Electromagnetic components, such as inductors and filters, are used in a variety of applications. In many industrial applications, inductors and filters are integral components in a wide array of machines. Important factors in the design of electromagnetic components, such as inductors include: cost, size, heat dissipation, noise level, efficiency, and inductance capacity.

BRIEF DESCRIPTION OF THE DRAWINGS

A more complete understanding of the present invention is derived by referring to the detailed description when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that are performed concurrently or in different order are illustrated in the figures to help to improve understanding of embodiments of the present invention.

DETAILED DESCRIPTION OF THE INVENTION

The present invention is described partly in terms of functional components and various assembly and/or operating steps. Such functional components may be realized by any number of components configured to perform the specified functions and achieve the various results. For example, the present invention may employ various elements, materials, coils, cores, filters, supplies, loads, passive and active components, and the like, which may carry out a variety of functions. In addition, the present invention may be practiced in conjunction with any number of applications, environments, and passive circuit elements. The systems and components described are merely exemplary applications for the invention. Further, the present invention may employ any number of conventional techniques for manufacturing, assembling, connecting, operating, and the like.

In one embodiment of the invention, an inductor or toroidal inductor is mounted on the inductor edge, is vibration isolated, and/or is optionally temperature controlled.

Figure 1A:
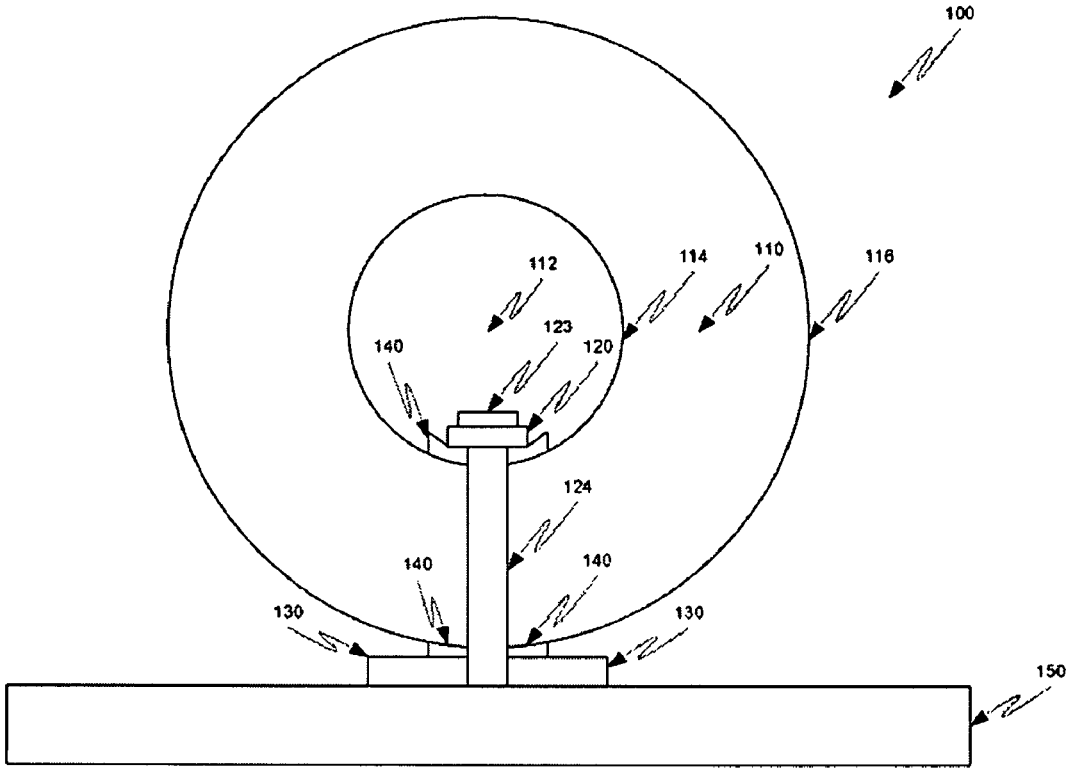
FIGS. 1A and 1B illustrate a vertically mounted inductor in (A) a face perspective and (B) an edge perspective, respectively.
Figure 1B:
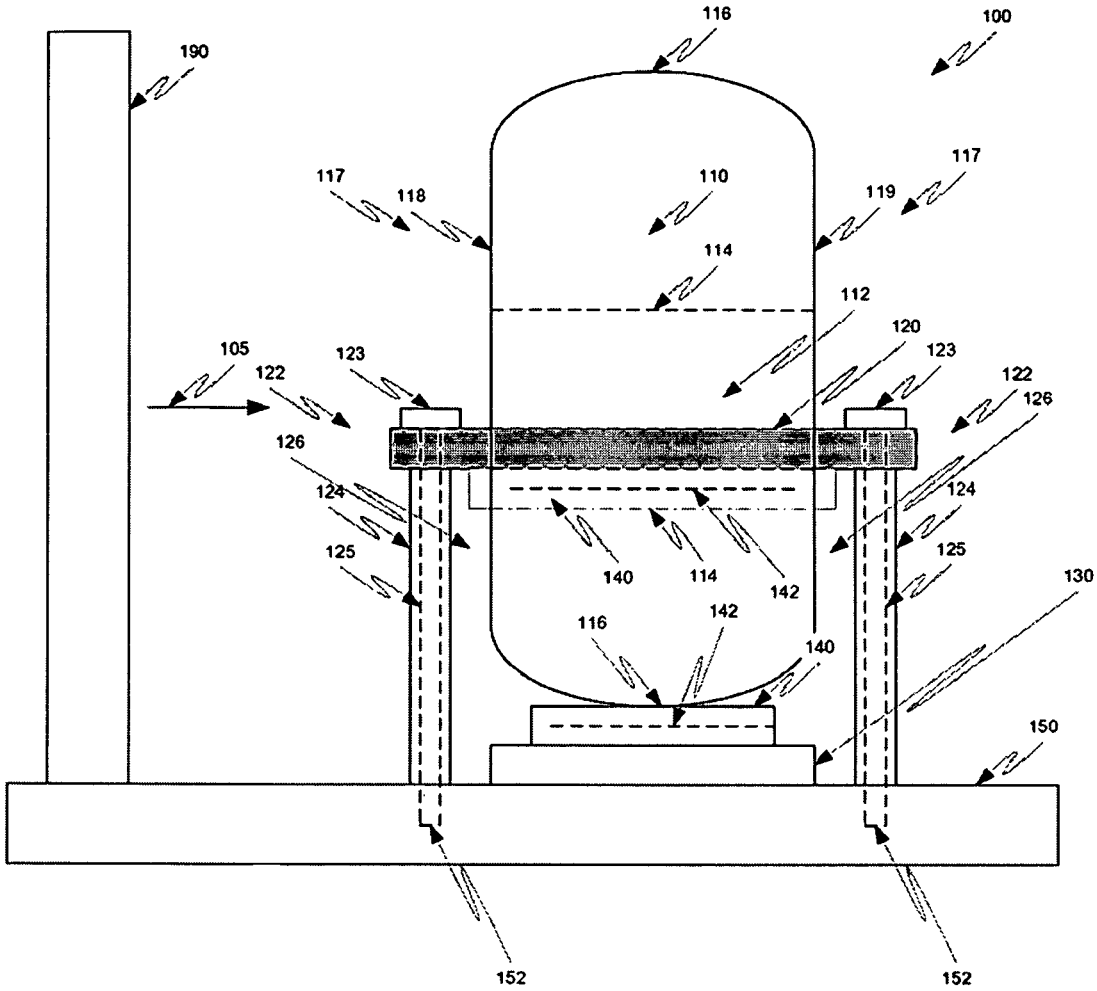

Referring now to FIG. 1, an example of an edge mounted inductor system 100 is illustrated. FIG. 1 illustrates an edge mounted toroidal inductor from two perspectives: (A) a face view and (B) an edge view. When looking through a center hole 112 of an inductor 110, the inductor 110 is viewed from its face. When looking at the inductor 110 along an axis-normal to an axis running through the center hole 112 of the inductor 110, the inductor 110 is viewed from its edge. In an edge mounted inductor system, the edge of the inductor is mounted to a surface. In a face mounted inductor system, the face of the inductor 110 is mounted to a surface.

The inductor 110 is mounted in a vertical orientation, where a center line through the center hole 112 of the inductor runs along an axis 105 that is about horizontal or parallel to a mounting surface 130 or baseplate 150. The mounting surface is optionally horizontal or vertical, such as parallel to a floor, parallel to a wall, or parallel to a mounting surface on a slope. In FIG. 1, the inductor 110 is illustrated in a vertical position relative to a horizontal mounting surface with the axis 105 running parallel to a floor. While descriptions herein use a horizontal mounting surface to illustrate the components of the edge mounted inductor mounting system 100, the system is equally applicable to a vertical mounting surface. To further clarify, the edge mounted inductor system 100 described herein also applies to mounting the edge of the inductor to a vertical mounting surface or an angled mounting surface. In these cases, the axis 105 still runs about parallel to the mounting surface, such as about parallel to the vertical mounting surface or about parallel to a sloped mounting surface 130, baseplate 150, or other surface.

The inductor 110 has an inner surface 114 surrounding the center hole 112, an outer edge 116 or outer edge surface, and two faces 117, including a front face 118 and a back face 119. The surface of the inductor 110 includes: the inner surface 114, outer edge 116 or outer edge surface, and faces 117. The surface of the inductor may include the outer surface of the magnet wire windings surrounding the core of the inductor 110. The magnet wire is may comprise a wire with an aluminum oxide coating for minimal corona potential. The magnet wire may be temperature resistant or rated to at least 200 degrees Centigrade. The minimum weight of the inductor is about 2, 5, 10, or 20 pounds.

A clamp bar 120 runs through the center hole 112 of the inductor 110. The clamp bar 120 may comprise a single piece, but is optionally composed of multiple elements. The clamp bar 120 is connected directly or indirectly to the mounting surface 130 and/or to a baseplate 150. The clamp bar is composed of a non-conductive material as metal running through the center hole of the inductor 110 acts as a magnetic shorted turn in the system. The clamp bar 120 may comprise a rigid material or a semi-rigid material that bends slightly when clamped, bolted, or fastened to the mounting surface 130. The clamp bar 120 may be rated to a temperature of at least 130 degrees Centigrade. In one embodiment, the clamp bar material is a fiberglass material, such as a thermoset fiberglass-reinforced polyester material, that offers strength, excellent insulating electrical properties, dimensional stability, flame resistance, flexibility, and high property retention under heat. An example of a fiberglass clamp bar material is Glastic® (Rochling Glastic Composites, Ohio). Optionally the clamp bar 120 is a plastic, a fiber reinforced resin, a woven paper, an impregnated glass fiber, circuit board material, a high performance fiberglass composite, a phenolic material, a thermoplastic, a fiberglass reinforced plastic, a ceramic, or the like, which may be rated to at least 150 degrees Centigrade. Any of the mounting hardware 122 is optionally made of these materials.

The clamp bar 120 may be attached to the mounting surface 130 via mounting hardware 122. Examples of mounting hardware include: a bolt, a threaded bolt, a rod, a clamp bar 120, a mounting insulator 124, a connector, a metal connector, and/or a non-metallic connector. The mounting hardware may be non-conducting. The mounting hardware 122 may be contained in or isolated from the inductor 100 via a mounting insulator 124. An electrically insulating surface may be included, such as on the mounting hardware. The electrically insulating surface proximately contacts the faces of the inductor 110. Alternatively, an insulating gap 126 of at least about one millimeter ma be defined between the faces 117 of the inductor 110 and the metallic or insulated mounting hardware 122, such as a bolt or rod.

An example of a mounting insulator is a hollow rod where the outer surface of the hollow rod is non-conductive and the hollow rod has a center channel 125 through which mounting hardware, such as a threaded bolt, runs. This system allows a stronger metallic and/or conducting mounting hardware to connect the clamp bar 120 to the mounting surface 130. FIG. 1 illustrates an exemplary bolt head 123 fastening a threaded bolt into the baseplate 150 where the baseplate has a threaded hole 152. An example of a mounting insulator 124 is a mounting rod. The mounting rod may be composed of a material or is at least partially covered with a material where the material is electrically isolating.

The mounting hardware 122 may cover a minimal area of the inductor 110 to facilitate cooling with a cooling element 190, such as via one or more fans. In one case, the mounting hardware 122 does not contact the faces 117 of the inductor 110. In another case, the mounting hardware 122 contacts the faces 117 of the inductor 110 with a contact area. The contact area may be less than about 1, 2, 5, or 10 percent of the surface area of the faces 117. The minimal contact area of the mounting hardware with the inductor surface facilitates temperature control and/or cooling of the inductor 110 by allowing airflow to reach the majority of the inductor 110 surface. The mounting hardware may be temperature resistant to a selected temperature, such as at least 130 degrees Centigrade. The mounting hardware 122 may comprise curved surfaces along its length to facilitate airflow around the length of the mounting hardware 122 to the faces 117 of the inductor 110.

The mounting hardware 122 connects the clamp bar 120, which passes through the inductor, to the mounting surface 130. The mounting surface 120 may be non-metallic and rigid or semi-rigid. Generally, the properties of the clamp bar 120 may apply to the properties of the mounting surface 130. The mounting surface 130 may be (1) composed of the same material as the clamp bar 120 or (2) a distinct material type from that of the clamp bar 120.

In one example the inductor 110 is held in a vertical position by the clamp bar 120, mounting hardware 122, and mounting surface 130 where the clamp bar 120 contacts the inner surface 114 of the inductor 110 and the mounting surface 130 contacts the outer edge 116 of the inductor 110.

In a second example, one or more vibration isolators 140 are used in the mounting system. A first vibration isolator 140 is positioned between the clamp bar 120 and the inner surface 114 of the inductor 110 and a second vibration isolator 140 is positioned between the outer edge 116 of the inductor 110 and the mounting surface 130. The vibration isolator 140 may operate as a shock absorber. The vibration isolator deforms under the force or pressure necessary to hold the inductor 110 in a vertical position or edge mounted position using the clamp bar 120, mounting hardware 122, and mounting surface 130. The vibration isolator may be temperature rated to a selected level, such as at least 200 degrees Centigrade. The vibration isolator 140 may be about ⅛, ¼, ⅜, or ½ inch in thickness. An example of a vibration isolator is silicon rubber. The vibration isolator 140 may contain a glass weave 142 for strength. The vibration isolator may be internal to the inductor opening or extend out of the inductor 110 central hole 112.

A common mounting surface 130 may be used as a mount for multiple inductors. Alternatively, the mounting surface 130 may be connected to a baseplate 150. The baseplate 150 may be used as a base for multiple mounting surfaces connected to multiple inductors, such as three inductors used with a three-phase power system where one inductor handles each phase of the power system. The baseplate may support multiple cooling elements, such as one or more cooling elements per inductor. The baseplate may comprise a strong and durable material, such as metal. The system reduces cost associated with the mounting surface 130 as the less expensive baseplate 150 is used for controlling relative position of multiple inductors and the amount of mounting surface 130 material is reduced and/or minimized. Further, the contact area ratio of the mounting surface 130 to the inductor surface may be minimized, such as to about 1, 2, 4, 6, 8, or 10 percent, to facilitate efficient heat transfer by maximizing the surface area of the inductor 110 available for cooling by the cooling element 190 or by passive cooling.

A cooling system 190 may cool the inductor. In one example, a fan blows air about one direction, such as horizontally, through the center hole 112, onto the front face 118, along the inner edge 114 of the inductor 110, and/or along the outer edge 116 of the inductor 110 where the clamp bar 120, vibration isolator 140, mounting hardware 122, and mounting surface 130 combined contact less than about 1, 2, 5, or 10 percent of the surface area of the inductor 110, which yields efficient cooling of the inductor 110 using minimal cooling elements and associated cooling element power due to a large fraction of the surface area of the inductor 110 being available for cooling.

Mounting hardware 122 may be used on both sides of the inductor 110. The inductor 110 mounting hardware 122 may also be used beside only one face of the inductor 110. The clamp bar 120 or other suitable structure may press down or hook over the inductor 110 through the hole 112 or over the entire inductor 110, such as over the top of the inductor 110.

Figure 2:
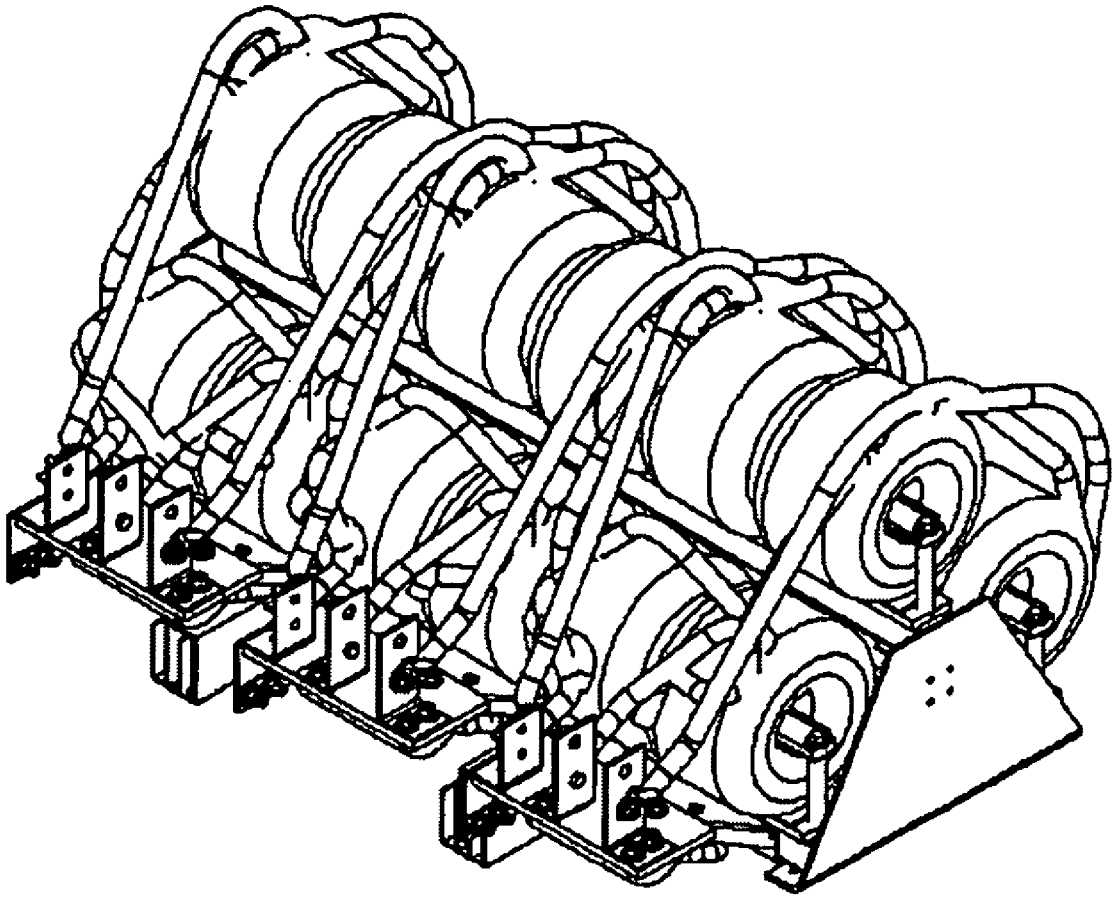
FIG. 2 illustrates a multiple vertical inductor mounting system.

Referring now to FIG. 2, an example of a system of edge mounting multiple inductors is provided. In this particular example, eighteen inductors are edge mounted using the present mounting system. FIG. 2 illustrates that 1, 2, 3, or more inductors are mounted in a single system using the edge mounted system. Further, FIG. 2 illustrates banks of inductors at varying vertical heights to facilitate heat transfer using an airflow across the bank of inductors.

In another embodiment, a section or row of inductors may be elevated in a given airflow path. In this layout, a single airflow path or thermal reduction apparatus is used to cool a maximum number of toroid filter inductors in a filter circuit, reducing additional fans or thermal management systems required as well as overall packaging size. This increases the robustness of the filter with fewer moving parts to degrade as well as minimizing cost and packaging size.

In another example, the elevated layout allows air to cool inductors in the first row and then also cools inductors in an elevated rear row without excessive heating of the air from the front row and with a single airflow path and direction from the thermal management source. Through elevation, a single fan may be used to cool multiple inductors approximately evenly, where multiple fans would have otherwise been needed to achieve the same result. This efficient concept drastically reduces fan count and package size and allows for cooling airflow in a single direction.

The pedestal or non-planar baseplate, on which the inductors are mounted, is made out of any suitable material. In the current embodiment, the pedestal is made out of sheet metal and fixed to a location behind and above the bottom row of inductors. Multiple orientations of the pedestal and/or thermal management devices are similarly implementable to achieve these results. In this example, toroid inductors mounted on the pedestal use a silicone rubber shock absorber mounting concept with a bottom plate, baseplate, mounting hardware 122, a center hole clamp bar with insulated metal fasteners or mounting hardware 122 that allows them to be safe for mounting at this elevated height. The mounting concept includes a Glastic® or other non-conductive material of suitable temperature and mechanical integrity as a bottom mounting plate. The toroid sits on a shock absorber of silicone rubber material of suitable temperature and mechanical integrity. In this example, the vibration isolator 140, such as silicone rubber, is about 0.125 inch thick with a woven fiber center to provide mechanical durability to the mounting. The toroid is held in place by a center hole clamp bar of Glastic® or other non-conductive material of suitable temperature and mechanical integrity. The clamp bar fits through the center hole of the toroid and may have a hole on each end, such as at least two total holes, to allow fasteners to fasten the clamp bar to the bottom plate and pedestal or baseplate. Beneath the center clamp bar is another shock absorbing piece of silicone rubber with the same properties as the bottom shock absorbing rubber. The clamp bar is torqued down on both sides using standard metal fasteners. The fasteners may comprise an insulated non-conductive material of suitable temperature and mechanical integrity. This system allows for the elevated pedestal inductors to be mounted with the center hole parallel to the mounting chassis and allows the maximum surface area of the toroid to be exposed to the moving air; thus maximizing the efficiency of the thermal management system. In addition, this mounting system allows for the two shock absorbing rubber or equivalent materials to both hold the toroid inductor in this upright position. The shock absorbing material also absorbs additional shock and vibration resulting during operation, transportation, or installation so that core material shock and winding shock is minimized.

The filter assembly may rest on a mounting plate, such as a plate of non-conductive material. All items of the filter mount to this plate as the plate provides both mechanical mounting isolation and electrical isolation. The plate is made of any suitable material in any suitable thickness which meets the relevant engineering criteria. In the present embodiment; the plate is made of mounting hardware 122 materials, or glass epoxy equivalent material in about ⅜ inch or about ½ inch thickness with some of the mounting holes having a counter sink in the bottom of the plate to allow flat head fasteners to hold filter items, such as toroid inductors and Glastic® input and output terminal mounts, which in turn hold capacitor busbars, fans, and terminal blocks.

The inductor 110 may include a pressed powder highly permeable and linear core having a BH curve slope of about 11 ΔB/ΔH surrounded by windings and an integrated cooling system.

Figure 3:
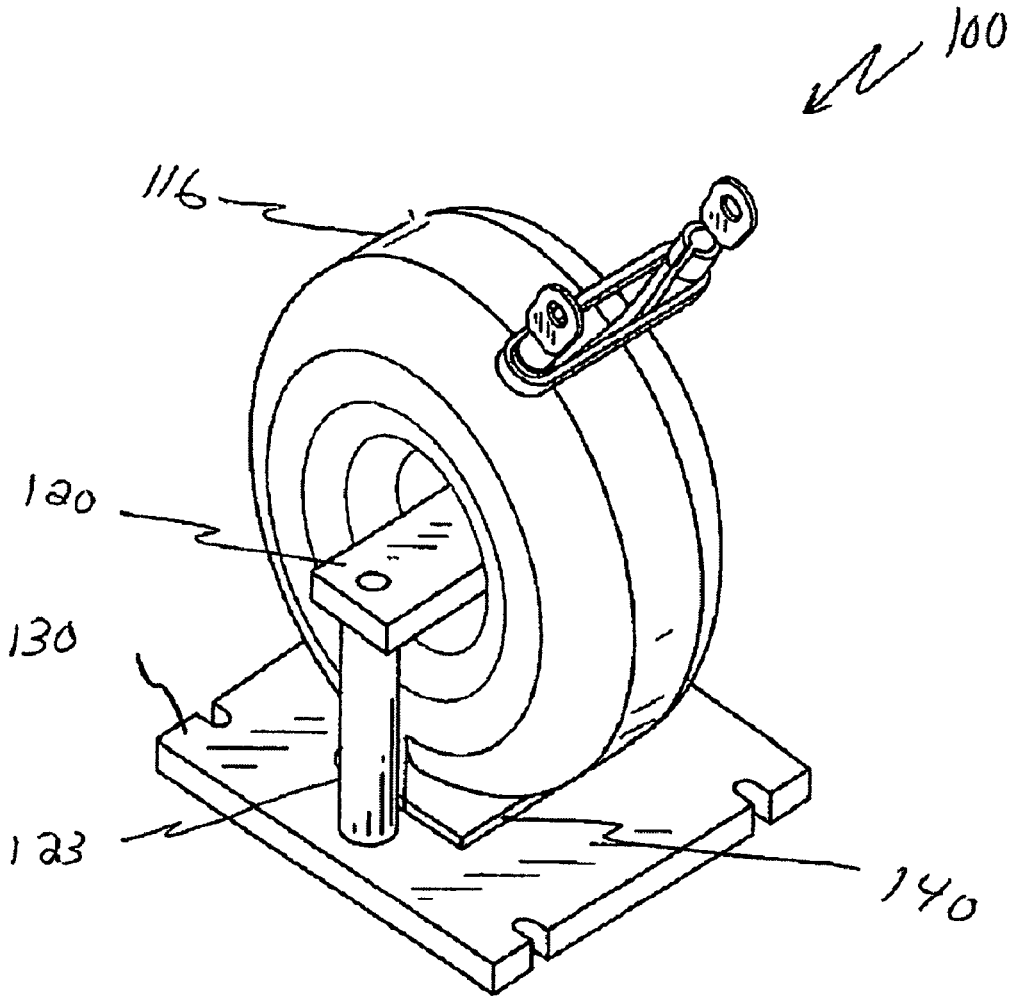
FIG. 3 is a perspective view of an inductor.

Referring now to FIG. 3, the inductor 110 comprises a core and a winding. The inductor may include any additional elements or features, such as other items required in manufacturing. The winding is wrapped around the core. The core provides mechanical support for the winding and is characterized by a permeability for storing a magnetic field in response to current flowing through the winding. Permeability may be defined in terms of a slope of ΔB/ΔH. The core and winding are suitably disposed on or in a mount or housing to support the core in any suitable position and/or to conduct heat away from the core and the winding.

The core comprises any suitable core for providing the desired magnetic permeability and other characteristics and is selected according to any suitable criteria. Suitable criteria include: BH curve profiles, permeability, availability, cost, operating characteristics in various environments, ability to withstand various conditions, heat generation, thermal aging, thermal impedance, thermal coefficient of expansion, curie temperature, tensile strength, core losses, and compression strength.

For example, the core may be configured to exhibit low core losses under various operating conditions, such as in response to a high frequency pulse width modulation or harmonic ripple, compared to conventional materials. Conventional core materials are laminated silicon steel or conventional silicon iron steel designs. The core may comprise an iron powder material or multiple materials to provide a specific BH curve. The specified BH curve allows creation of inductors having: smaller components, reduced emissions, reduced core losses, and increased surface area in a given volume when compared to inductors using the above described traditional materials.

There are two quantities that physicists use to denote magnetic field, B and H. The vector field H is known among electrical engineers as the magnetic field intensity or magnetic field strength also known as auxiliary magnetic field or magnetizing field. The vector field H is a function of applied current. The vector field B is known as magnetic flux density or magnetic induction and has the SI units of Teslas (T). Thus, a BH curve is induction, B, as a function of the magnetic field, H.

In one exemplary embodiment, the core comprises a pressed powdered iron alloy material. The core includes a distributed gap, which is introduced by the powdered material and one or more bonding agents. Substantially even distribution of the bonding agent within the iron powder of the core results in the equally distributed gap of the core. The resultant core loss at the switching frequencies of the electrical switches substantially reduces core losses when compared to silicon iron steel used in conventional iron core inductor design. Further, conventional inductor construction requires gaps in the magnetic path of the steel lamination, which are typically outside the coil construction and are, therefore, unshielded from emitting flux, causing electromagnetic radiation. The electromagnetic radiation can adversely affect the electrical system. The distributed gaps in the magnetic path of the present core material are microscopic and substantially evenly distributed throughout the core. The infinitely smaller flux energy at each gap location is also surrounded by a winding which acts as an electromagnetic shield to contain the flux energy. Thus, a pressed powder core surrounded by windings results in substantially reduced electromagnetic emissions.

Referring now to Table 1, suitable inductance B levels as a function of magnetic force strength are provided. The core material may comprise: an inductance of about −4400 to 4400 B with over range of about −400 to 400H with a slope of about 11 ΔB/ΔH. Herein, permeability refers to the slope of a BH curve and has units of ΔB/ΔH. Core materials having a substantially linear BH curve with ΔB/ΔH in the range of 10 to 12 may be utilized. In other embodiments, core materials having a substantially linear BH curve with a permeability, ΔB/ΔH, in the range of 9 to 13 are acceptable.

TABLE 1

| Typical Permeability 11 BH Response | |
|---|---|
| B (Tesla/Gauss) | H (Oersted) |
| −4400 | −400 |
| −2200 | −200 |
| −1100 | −100 |
| 1100 | 100 |
| 2200 | 200 |
| 4400 | 400 |

In one embodiment, the core material exhibits a substantially linear flux density response to magnetizing forces over a large range with very low residual flux, Br. The core may provide inductance stability over a range of changing potential loads, from low load to full load to overload.

The core may be configured in a toroidal shape where the toroid is of any size. The configuration of the core may be selected to maximize the inductance rating, $A_L$, of the core, enhance heat dissipation, reduce emissions, facilitate winding, and/or reduce residual capacitances.

In some embodiments, a filter circuit may include multiple inductors configured in parallel and/or series to provide the desired inductance characteristics. Multiple inductors are used in other applications, such as to operate in conjunction with a poly-phase power system where one inductor handles each phase.

The toroidal shape allows considerably less cross sectional area of conductor for a given current rating. Because the conductor is on the outside of the core, with virtually 100% of its surface area exposed, it can be controlled by cooling elements, a high thermal transfer compound, a heat sink, liquid, air, and/or convection cooling. The reduction in required conductor size reduces the overall size and weight of the inductor, transformer, or other electromagnetic component.

The reduction in necessary conductor size allows the toroid configuration to use more turns to obtain the desired inductance for the filter circuit. Inductance is the product of the inductance rating and the square of the turns. Therefore, additional turns achieve desired inductance. Increasing turns due to reduced cross sectional conductor requirements facilitate achieving a desired inductance in a reduced package weight and size.

Reduced noise from THISS Technology® inductors may contribute to the filter performance in many applications. THISS Technology® toroid inductor designs have a solid, pressed iron powder core which has low noise emissions when energized with its filter load. In addition, in one embodiment, the entire THISS Technology® wound toroid inductor is vacuum impregnated with silica filled varnish to form a solid mass for low noise when energized. When mounted in vertical form using silicone rubber shock absorbers or potted with epoxy to integrate with liquid cooling heat sinks; THISS Technology® inductors have very low dB noise levels as compared to silicon iron steel, metglas, or other known inductor technologies when fully energized. The low dB levels of THISS Technology® inductors make the filter well suited for high power applications where noise levels cannot exceed specified dB levels.

Reduced size and weight filters may be important for various applications, and THISS Technology® inductors reduce the weight and size of the filter by approximately half or about a factor of 2 when compared to conventional silicon iron steel inductors. This is achieved by the combination of the BH curve of the iron powder and carbonyl powder core materials, the low core losses of these materials at the PWM frequencies, the geometry which maximizes copper magnet wire surface area in a given inductor volume, and the conductors having multiple strands of round copper magnet wire to maximize copper cross section in a given inductor volume. When combined the resultant THISS Technology® inductor has the ability to remove its losses (heat) and maintain an operating temperature that conforms to its UL Recognized insulation system and maintain a specified inductance all in a weight and volume that is approximately half of what is needed when conventional silicon iron steel or Metglas® core materials are used. Light weight filters of half the size and weight of conventional designs allow for reductions in filter cabinet and filter panel sizes for optimized packaging when integrated with PWM converter/inverters.

Increased efficiency of the filter is achieved when THISS Technology® inductors are used as compared to conventional silicon iron steel or Metglas inductors. The increase in efficiency is directly related to the small size, weight, and overall losses of THISS Technology® inductors when compared to conventional silicon iron steel, Metglas® and/or the like designs. Efficiency is the total power loss of energy across the filter stage. The power loss includes any or all of: core loss, copper loss, power factor, and harmonics. A conventional design inductor having twice the weight of a THISS Technology® inductor and operating at the same temperature in the same filter circuit has considerably higher power losses than a THISS Technology® inductor at half the weight. To heat up a conventional inductor at twice the weight of THISS Technology® inductor to an identical operating temperature for both inductors takes considerably more energy or power. This additional energy required to reach temperature stabilization on a much heavier conventional inductor design is lost in heat; thus decreasing the efficiency of a heavy, conventional silicon iron steel, Metglas® inductor, and/or the like design as compared to a highly efficient, light weight THISS Technology® inductor design. This increase in efficiency, decrease in total watts of heat loss, when using THISS Technology® inductors in the filter may contribute to overall system efficiency when power generation sources are being filtered and are feeding power back to the power grid.

Efficiency may be useful in conjunction with renewable energy power sources, such as wind turbine, fuel cell, biomass, solar, hydroelectric sources, as well as conventional power generation, such as nuclear and coal.

The winding comprises a conductor for conducting electrical current through the inductor. The winding may comprise any suitable material for conducting current, such as conventional wire, foil, twisted cables, and the like formed of copper, aluminum, gold, silver, or other electrically conductive material or alloy at any temperature with an insulation over the conductor characterized as "magnet wire" in the motor or transformer industry. In one embodiment, the winding is copper magnet wire rated to about 200 degrees Centigrade with an optional additional anti-corona silicone jacket for maximum reliability in high rates of change of voltage with time (dV/dt) applications wound around the core in one or more layers.

The magnet wire may comprise round wire to expose greater area for cooling the core. Alternatively, the magnet wire may comprise rectangular wire or other geometry to facilitate more windings within a particular area. Additionally, the winding is optionally any other suitable material, such as non-conductive material in any configuration. The type and configuration of winding and the number of turns and layers is selected according to the desired characteristics of the inductor. In one example, the winding is round magnet wire wound in multiple layers to reduce the energy stored by the inductor.

The winding is configured in any suitable manner, for example with multiple conductors. For example, the winding optionally includes two or more strands of conductor wire in one or more layers. In one example, the winding includes two or more layers of conductor, wherein each turn of the second and further out layers are wound as close as possible to the identical turn number of the first layer to minimize the voltage between each layer and minimize the effective turn to turn capacitance of the whole winding when all start conductors are connected in parallel and all finish conductors are connected in parallel. This low capacitance allows the inductor to maintain its inductive properties at much higher frequencies for a more desired filter inductor. The winding is suitably wrapped around the smallest diameter of the core in a spiral and or any other suitable pattern. In one embodiment, the winding comprises multiple strands of wire, such as forty strands of 15 American Wire Gauge (AWG) wire, each of which is wrapped around the smallest diameter of the core individually and co-terminated with the other strands such that all forty strands are wired in parallel. In another example, the toroid configuration of the core is substantially encased by the winding, preventing magnetic flux leakage and reducing electromagnetic interference (EMI) emissions from the inductor.

In addition, the present configuration using round magnet wire wound one layer on top of another layer provides a low, potentially nearly zero, effective turn-to-turn voltage. The energy stored, therefore, is very low as well. Energy stored corresponds to the capacitance times the square of the voltage applied. The energy stored is reduced by the square of the turn to turn voltage reduction, thus reducing energy stored in the present configuration. Further, the self resonant frequency (SRF) is inversely related to energy stored and is a simple test to confirm low energy stored construction. Toroid configurations tend to exhibit higher SRFs than conventional configurations and can sometimes allow the system to operate with smaller value capacitors in a given filter circuit.

In this configuration, the winding nearly entirely covers the toroid core. Leakage flux is inhibited from exiting the toroid inductor, thus reducing EMI emissions. The windings tend to act as a shield against such emissions. In addition, the soft radii in the geometry of the windings and the core material are less prone to leakage flux than conventional configurations.

Additionally, the component geometry increases the surface area of the primary heat sources, which is the winding wire. Maximizing the surface area of this primary heat source allows the filter design to integrate with a cooling system, such as forced air, liquid cooled heat sinks, and other cooling systems, to increase the efficiency of the filter in a smaller package size.

The winding configuration of THISS Technology® inductors minimizes the turn-to-turn capacitance and increases the resonant frequency far beyond the capability standard silicon iron steel core inductors with sheet foil windings of square or rectangle magnet wire windings. The low turn to turn capacitance is achieved through physical separation of start and finish winding wires and precision winding each turn of each layer of magnet wire in an attempt to create a very low voltage between turns of the inductor. The resulting low capacitance, high resonance, allows THISS Technology® inductor designs to maintain their impedance typically up to 300 to 400 times what is achieved by conventional silicon iron steel inductors. The impedance at these higher frequencies gives the filter maximum flexibility to be utilized at very high PWM frequencies when using THISS Technology® inductors.

The edge mounted inductor system 100 may include an electrical system, a filter, and/or a filter system. Power from the inductor 110 is optionally filtered. An electrical system according to various aspects of the present invention is implemented with a power supply. The power supply is configured for any appropriate application or environment, such as variable speed drive systems, adjustable speed drive systems, grid-tied applications, uninterruptible power supplies and backup power systems, such as systems using superconducting magnets, batteries, and/or flywheels. The electrical system is usable with at least medical equipment and inverters and/or converters for renewable energy systems. Examples of renewable energy systems include solar, fuel cell, wind turbine, hydrogen, natural gas turbine. The power supply is particularly adapted for high current applications, such as applications exceeding 100 $A_{rms}$, for example more than 300 $A_{rms}$, in many applications exceeding 500 $A_{rms}$.

In one example, the present exemplary electrical system includes a filter system, a phase converter, an AC/DC converter, and a power generation device. The power generation device generates power for delivery to a load. If conversion to AC or DC is required, the power generated by the power generation device is provided to the AC/DC converter, which converts AC current to DC current and/or vice versa. If conversion to a different phase configuration is required, the current is provided to the phase converter, which may convert the phase of the signal, such as from a three-phase supply to a single-phase supply and/or vice versa. The filter system filters unwanted components of the electrical current from the generated signal, such as high frequency transients generated by the phase converter, AC/DC converter, and/or power generation device.

The power generation device provides power, such as in the form of electrical voltage and current. The power generation device optionally includes any appropriate system for generating power, such as conventional generators. The power generating device optionally generates any type of power, such as AC or DC current, single-phase or three-phase current, and the like. In one embodiment, the power generation device comprises a variable speed source, such as a wind turbine or the like, generating high AC three-phase current.

The AC/DC converter converts AC current to DC current and/or vice versa. The AC/DC. converter optionally includes any appropriate system, such as a conventional AC/DC converter. The AC/DC converter optionally adjusts other aspects of the power, such as regulating the voltage, changing the number of phases, and/or filtering the signal to control noise. In the present embodiment, the AC/DC converter includes a conventional AC/DC converter including a regulator to regulate the output voltage. The present AC/DC converter may also be configured to convert the three-phase AC input signal to a single-phase DC signal.

The phase converter converts the number of phases of the signal, such as from a three-phase supply to a single-phase supply and/or vice versa. The phase converter is configured in any appropriate manner to generate the desired number of phases for the output. In the present embodiment, the phase converter may include a pulse width modulation converter to convert the single-phase input signal to a three-phase output. In particular, the phase converter includes multiple transistors, such as integrated gate bipolar transistors (IGBTs), controlled by a logic controller to implement the conversion. The phase converter may, however, be implemented in any suitable manner to generate the appropriate number of phases.

Thus, in one embodiment, various aspects of the present invention are implemented in a pulse width modulation (PWM) filter application for inverting/converting power from a generating power source back to a power grid.

In the present embodiment, the power supply system optionally includes any other appropriate elements or systems, such as voltage or current sources, switching systems comprising multiple integrated gate bipolar transistors (IGBTs), power field effect transistors (FET's), gate turn off devices (GTO's), silicon controlled rectifiers (SCR's), triacs, thyristors, and/or any other electrically operated switches. The system optionally uses various forms of modulation including: pulse width modulation, resonant conversion, quasi-resonant conversion, phase modulation, or any other suitable form of modulation.

The filter system filters undesired elements from the signal, such as noise and high frequency transients induced by other components, for example switching noise and/or harmonic components generated by the phase converter's IGBTs, to reduce total harmonic distortion (THD). The filter system optionally includes any appropriate system for transmitting selected frequencies and attenuating others. For example, the filter system optionally includes a passive analog filter system comprising one or more inductors, capacitors, and/or resistances. The filter system optionally filters higher frequency harmonics in the supply signal, such as harmonies induced by the IGBTs and or any other electrically operated switches. The filter circuit is configured in any suitable manner to filter the selected components.

In another embodiment, the filter system comprises passive components including one or more electromagnetic components. In particular, the filter system may include at least one inductor and at least one capacitor. The values and configuration of the inductor and the capacitor are selected according to any suitable criteria, such as to configure the filter circuit for a selected cutoff frequency, which determines the frequencies of signal components to be filtered by the filter circuit.

One or more of the inductors or other electromagnetic components operate in conjunction with an electric current creating a magnetic field, such as with a transformer and/or an inductor. In one embodiment, the inductor is configured to operate according to selected characteristics, such as in conjunction with high current without excessive heating or exceeding safety compliance temperature requirements. The inductor optionally includes any additional elements or features, such as other items required in manufacturing. The winding is wrapped around a core. The core provides mechanical support for the winding and is characterized by a permeability for storing a magnetic field in response to current flowing through the winding. The core and winding are suitably disposed on or in a mount or housing to support the core in any suitable position and/or to conduct heat away from the core and the winding.

The core may comprise any suitable core for providing the desired magnetic permeability and other characteristics, and is selected according to any suitable criteria, such as permeability, availability, cost, operating characteristics in various environments, ability to withstand various conditions, heat generation, thermal aging, thermal impedance, thermal coefficient of expansion, curie temperature, tensile strength, and compression strength. In addition, the core material saturation curve, or BH curve, is selected to be more "linear" at higher magnetizing forces resulting in less drop in permeability with each equal increase in magnetic force compared to that of conventional silicon iron steel designs.

For example, the core may be configured to exhibit low core losses under various operating conditions, such as in response to a high frequency PWM or harmonic ripple, compared to conventional materials, like laminated silicon steel or conventional silicon iron steel designs. For example, the core may comprise a high inductance material or multiple materials to provide high inductance, smaller components, reduced emissions, and reduced core losses.

A filter system is implemented according to any appropriate criteria, such as fundamental frequency, PWM frequency, power level, and voltage. In one embodiment, the filter system is configured for approximately 2.0 kHz PWM frequency and the following features and values:

| | |
|---|---|
| Input Voltage: | 690 V (line-line); |
| Rated Current: | 600 $A_{rms}$; |
| Overload capacity: | 10% (or 660 $A_{rms}$) for 1 minute; |
| Input Line | 0.25 mH, 550 A THISS Technology ® |
| Inductor : | Toroid Inductor from CTM Magnetics, Inc.; |
| Input Inverter | 0.40 mH, 600 A THISS Technology ® Toroid |
| FilterInductor: | Inductor from CTM Magnetics, Inc.; and |
| Filter Capacitor: | 100 micro Farad THISS Technology ® (CTM Magnetics, Inc. Tempe) Toroid Inductor. |

A THISS Technology® Inductor design includes a toroid core having any of:

Iron Powder or Carbonyl Powder core material in a toroid shape;

Round Copper Magnet Wire Winding of more than one strand of Round Copper Magnet Wire;

Start, beginning of winding, magnet wires on one side of a physical or air separation spanning the OD, Top, Bottom, and ID of the toroid core with finish, end of winding, magnet wires on the opposite side of the separation. Winding turns for each winding layer are attempted to be in the same location from the inside layer to the outside layer to minimize turn to turn voltage from layer to layer and capacitance when all conductors are connected in parallel;

An RMS current rating of 150 A or higher in the filter circuit; and

Wound Toroid to be Vacuum Impregnated with Silica Filled Varnish for high thermal transfer.

The filter system filters unwanted components from the power signal, such as harmonics and noise. The power signal is provided to the inductor, which establishes a current in the winding. In the present embodiment, the core exhibits low core losses in response to high frequencies as compared to silicon iron steel. Consequently, the inductor generates less heat in response to the harmonics and other higher frequency noise in the power signal. In addition, the exposed surface of the core between the turns of the winding facilitates a lowering of the inductor to air thermal resistance thus reducing heat dissipation and increasing efficiency, especially in conjunction with the cooling system. The low losses of the core material reduce the overall power requirements of the inductor, thus reducing the necessary copper density for the winding. Moreover, because an inductor accommodates higher frequencies without overheating, as well as higher currents without saturating, the core does not need to be enlarged to reduce heat generation or avoid saturation. The addition of the thermal management system further reduces the effects of heat. Consequently, the inductor is relatively small and light to achieve the same or better performance and other operating characteristics.

The THISS Technology® filter inductors tend to optimize the packaging in terms of size and weight and enhance efficiency by minimizing power loss of the filter. The integration of THISS Technology® filter inductors in the circuit allows the filter to be approximately half the size and half the weight, to reduced noise, to reduced power loss, and to maintain filter impedance at about 300 to 400 times higher PWM frequencies when compared to conventional silicon iron steel or Metglas® (Metglas, Inc, SC) filter inductor technology.

One embodiment of the present invention results in a reduction in core loss related to the harmonic frequencies present in the waveforms when a converter/inverter is operating above 1 kHz switching frequency. This core loss reduction is amplified as the switching frequency rises. The core losses of iron powder are considerably lower than silicon iron steel.

In another embodiment, the toroid inductor geometry facilitates airflow to move through the inside diameter and around the outside diameter. In addition, the soft radii shape of the toroid promotes airflow. Moreover, the toroid inductor allows the system to use individual single phase toroids, which can be mounted anywhere inside a system cabinet or enclosure to further improve efficiency and reduce airflow restrictions, unlike the conventional configuration where air cannot easily flow through the center, around the sharp edges, and over the larger bulk.

The configuration of the core may be adapted to operate in a variety of conditions, such as low airflow environments and outdoor use. In one instance, the inductor includes a core in a toroid shape suitably supported by a housing or mount. The core is mounted to the housing in such a manner to prevent the inductor from shorting to ground, such as, for example, encasing the inductor in a thermally conductive dielectric material and using non-metallic connectors. This configuration allows the inductor to operate in environments, such as the outdoors as well as to conform to various manufacturing standards for various environments, such as, for example, those released by National Electrical Manufacturers Association (NEMA).

The large increase in the available surface area of the toroid inductor gives the system improved performance in low airflow environments when compared, for example, to conventional silicon iron steel. When mounted in a low profile, low airflow configuration, the toroid inductor promotes heat radiation. The heat generating elements may be located proximate to the heat radiating elements, unlike the considerably larger conventional silicon iron technology, which tends to have many of its hottest components disposed away from a heat sink. The toroid configuration provides an efficient transfer of thermal energy, supplying improved heat dissipation characteristics in low airflow environments and facilitating use of smaller cooling elements and heat sinks.

An optional thermally conductive compound applied to the inductor increases the thermal transfer efficiency from the windings and core to a heat sink device cooled by a cooling element. The thermally conductive compound is optionally used to fully encapsulate the inductor or transformer and seal it sufficiently to pass the NEMA 4 submersion test described in UL 50 for outdoor use. This allows the unit to stand alone, for example on the outside of a system cabinet. Consequently, the component is suitable for use in NEMA 4 outdoor system applications. The inductor resists shorting due to a floating or ungrounded core of the toroid construction. In addition, outdoor models are configured for the NEMA 4 submersion test in UL 50, for example by vertically mounting the toroid inductor with non-metallic machined parts.

The housing may include any system, device, or plurality of devices and systems suitably adapted to support the core in any position. In addition, the housing may be configured in any suitable manner to achieve any suitable result, such as to direct heat away from the core, to protect the core from the elements, or for any other purpose. The housing is composed of any suitable material. For example, the housing optionally includes a heat conducting material connected to a heat sink. The housing is suitably configured to minimize its interference with the winding and improve heat radiation characteristics. The housing and the inductor is configured to operate in a variety of conditions. In one embodiment, the electromagnetic component is encased in a thermally conductive compound that acts to both aid in heat dissipation and provide protection from the elements, for example in accordance with standards released by the National Electrical Manufacturers Association. In alternative embodiments, the housing comprises a thermal transfer medium, such as a thermally conductive material abutting the inductor to transfer heat away from the inductor, which is thermally connected to a heat sink. The housing is configured in any suitable manner to support and/or transfer heat away from the inductor.

In another embodiment, the housing is made of a non-conductive material, such as Glastic®, and has a center clamp bar through the center hole with metal hardware on each side securing the housing to the Glastic® base plate. This embodiment is used in applications where cooling elements are present, typically in the form of forced air. This housing embodiment supports the toroid vertically and maximizes the available surface area into the forced air cooling elements for maximum efficiency.

The edge mounted inductor system 100 optionally includes a cooling system to remove heat from the inductor. The cooling system includes any system for cooling the inductor and/or other elements of the electrical system, such as one or more fans, a liquid cooling system, and/or a heat sink. In one embodiment, the cooling system includes a fan blowing air across the inductor. In addition, the cooling system may include passive elements, such as the thermally conductive compound applied to the inductor, which increases the thermal transfer efficiency from the windings and core to a heat sink.

In another embodiment, the cooling system includes an active thermal management system. The active thermal management system circulates a coolant in thermal communication with the inductor. The coolant absorbs heat from the inductor and then moves to a heat exchanger where the coolant loses the heat. The active thermal management system includes any appropriate system and elements for providing a coolant to the inductor.

For example, the active thermal management system optionally includes a fluid cooling system having a cooling channel, a coolant, a heat exchanger, and a source. The source delivers the relatively cool coolant to the cooling channel, which is disposed in thermal communication with the inductor such that heat from the inductor is transferred to the coolant. The heated coolant travels to the heat exchanger, which removes the heat from the coolant. The coolant may be returned to the source for recirculation.

The coolant absorbs heat from a heat source, such as the inductor. The coolant may comprise appropriate coolant, such as a gas, liquid, or suspended solid. For example, the coolant may comprise a conventional coolant, such as water, a colligative agent, such as conventional antifreeze, a refrigerant, or other heat transfer fluid.

The cooling channel conducts the coolant to the inductor or other heat source. The cooling channel optionally conducts heat from the inductor to the coolant. For example, the cooling channel optionally includes a material having a high thermal transfer rate for transferring heat to the coolant. The material is selected for other properties as well, such as electromagnetic shielding effects to reduce the electromagnetic emissions of the inductor. In one case, the cooling channel covers as much of the inductor as is practical to remove heat from a large portion of the inductor's surface area. Alternatively, the cooling channel is configured to cover a reduced portion of the inductor's surface.

In one embodiment, the cooling channel comprises a coil of copper tubing approximately defining a cylinder. The inductor is disposed within the interior of the cylinder. The cooling channel is optionally configured to cover one or both ends of the cylinders and/or to cover the axial ends of the inductor.

For example, the cooling channel may comprise one or more tubes or other hollow members connected to the source and the heat exchanger, such as copper tubing. The cooling channel is coiled around the inductor. The coils are configured to make substantial constant contact with each other as the coils wind around the inductor to optimize the coverage of the cooling channel over the inductor. Alternatively, the cooling channel is otherwise configured, such as in the form of a cast element having interior channels for conducting the coolant and configured to cover one or more surface areas of the inductor. In another embodiment, the cooling channel also functions as the winding. For example, the winding and cooling channel include copper tubing, such that electrical current runs through the copper and the coolant runs within the hollow interior of the tubing.

The source provides the coolant to the cooling channel. The source includes any appropriate source of coolant, such as a water pipe, a pump, a compressor, and the like. In one embodiment, the source is a conventional pump for circulating the coolant through the cooling channel and the heat exchanger. If appropriate, the source is configured to pressurize the coolant, for example for use in conjunction with a gas coolant, such as a fluorocarbon or chlorofluorocarbon.

The heat exchanger removes heat from the coolant. The heat exchanger is any system for removing heat, such as a conventional heat sink, mechanical heat exchanger, fan, or a secondary cooling system. In one embodiment, the heat exchanger is a conventional heat exchanger having one or more channels exposed to a cooler environment. For example, the heat exchanger may comprise a return pipe between the outlet of the cooling channel and the input to the source. Alternatively, the heat exchanger may be omitted, for example by discarding the heated coolant.

The thermal management system optionally includes additional elements or features according to the environment or application of the electrical system. For example, the cooling channel may be disposed within a high thermal transfer rate potting compound to facilitate additional heat transfer away from the inductor. In addition, the cooling channel and/or the potting compound may be mounted on a mounting plate or bracket comprising a high thermal transfer rate material. Further, the volume or configuration of the cooling channel and the delivery rate of the source may be adjusted according to the heat removal requirements of the system, a desired time for reaching thermal equilibrium, or other relevant factors.

In one embodiment, the reduced size of the inductor compared to conventional inductors having similar performance characteristics creates a lower thermal mass and the heat removal increases the performance of the inductor and facilitate the use of a smaller inductor. Further, the inductor and the cooling channel are optionally sealed within a package, installed in a closed space, or even submerged. The inductor is configured to meet any relevant requirements. The inductor may be mounted to increase airflow over the inductors. This mounting configuration in conjunction with forced air elements decreases losses.

Additionally, a capacitor busbar mounting mechanism may minimizes space requirements and optimize packaging. The busbars integrate with the THISS technology filter output terminal. This efficient filter output terminal layout minimizes the copper cross section necessary for the capacitor busbars. The copper cross section is minimized for the capacitor busbar by sending the bulk of the current directly to the output. In these circuits, the current carrying capacity of the capacitor buss conductor is a small fraction of the full approximate 60 Hz load or fundamental frequency current sent to the output load via the output terminal. The termination of the THISS technology filter inductor is integrated to the capacitor bank for each phase and to the output termination to the filtered sine wave load. These busbars may be manufactured out of any suitable material and be any suitable shape. For instance, they may comprise a flat strip or hollow tube. In the present embodiment flat strips of tinned copper with threaded inserts are used for both mounting the capacitors mechanically as well as providing electrical connection to each capacitor. The present embodiment optimizes the packaging efficiency of the capacitors by mounting them vertically and staggering each capacitor from each side of a common busbar for maximum density in the vertical dimension. A common neutral bus bar is used between two phases to further reduce copper bus bar quantity and minimize size and a jumper busbar connects this common neutral point to the other phase efficiently using flat strip copper in the present embodiment. Connection fittings designed to reduce radio-frequency interference and power loss may be used. The busbars may be designed for phase matching and connecting to existing transmission apparatus. The integrated output terminal busbars provide for material handling of the filter assembly as well as connection to the sine wave filtered load or motor. Though a three-phase implementation is displayed, modifications may be made to adapt this integrated method to other power systems.

The particular implementations shown and described are illustrative of the invention and its best mode and are not intended to otherwise limit the scope of the present invention in any way. Indeed, for the sake of brevity, conventional manufacturing, connection, preparation, and other functional aspects of the system may not be described in detail. While single PWM frequency, single voltage, single power modules, in differing orientations and configurations have been discussed, adaptations and multiple frequencies, voltages, and modules is implemented in accordance with various aspects of the present invention. Furthermore, the connecting lines shown in the various figures are intended to represent exemplary functional relationships and/or physical couplings between the various elements. Many alternative or additional functional relationships or physical connections is present in a practical system.

In the foregoing description, the invention has been described with reference to specific exemplary embodiments; however, various modifications and changes is made without departing from the scope of the present invention as set forth herein. The description and figures are to be regarded in an illustrative manner, rather than a restrictive one and all such modifications are intended to be included within the scope of the present invention. Accordingly, the scope of the invention should be determined by the generic embodiments described herein and their legal equivalents rather than by merely the specific examples described above. For example, the steps recited in any method or process embodiment may be executed in any order and are not limited to the explicit order presented in the specific examples. Additionally, the components and/or elements recited in any apparatus embodiment may be assembled or otherwise operationally configured in a variety of permutations to produce substantially the same result as the present invention and are accordingly not limited to the specific configuration recited in the specific examples.

Benefits, other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, is varied or otherwise particularly adapted to specific environments, manufacturing specifications, design parameters or other operating requirements without departing from the general principles of the same.

The invention claimed is:

1. An inductor mount configured to mount to a mounting surface, comprising:

an inductor having a center opening, said inductor comprising a surface area encompassing all of: a front face, a back face, an inner surface about said center opening, and an outer edge concentric about said center opening;

mounting hardware holding said outer edge of said inductor to the mounting surface; and a cooling element, said cooling element configured to move air: into contact with said front face, through said center opening, and around said outer edge of said inductor, wherein said mounting hardware contacts less than ten percent of said surface area of said inductor.

2. The inductor mount of claim 1, wherein said mounting hardware comprises a clamp element running through said center opening of said inductor, wherein said clamp element comprises a non-conducting material.

3. The inductor mount of claim 1, wherein said inductor comprises a substantially annular core, wherein said substantially annular core comprises a mass of a core material, said core material comprising an equally distributed gap at a particulate scale throughout said mass of said substantially annular core, said inductor further comprising:

a conductor wound about said substantially annular core, wherein said inductor operates at current levels in excess of about one hundred amperes, wherein said inductor exhibits a permeability of less than thirteen delta Gauss per delta Oersted at a load of four hundred Oersteds, wherein, during use, a period of alternating current flowing through said inductor is present at greater than about five hundred Hertz.

4. The inductor mount of claim 3, said substantially annular core comprising:

a pressed powder alloy comprising iron powder and a bonding agent, wherein said iron powder and said bonding agent are substantially evenly distributed through said mass of said core.

5. The inductor mount of claim 4, wherein, said inductor exhibits a permeability of less than about ten delta Gauss per delta Oersted at a load of four hundred Oersteds.

6. The inductor mount of claim 3, wherein said substantially annular core exhibits a substantially linear flux density response to magnetizing forces over a range of −400 to 400 H.

7. An inductor mount configured to connect to a mounting surface, comprising:

an inductor having a center tunnel, said inductor comprising: a front face, a back face, an inner surface about said center tunnel, and an outer edge running concentrically about said inner surface, wherein said inductor comprises a surface area comprising all of: said front face, said inner surface, and said outer edge;

a non-conducting clamp element running through said center tunnel of said inductor; and mounting hardware configured to connect said clamp element to the mounting surface, wherein said mounting hardware and clamp element combine to edge mount said inductor to the mounting surface, wherein said cooling element simultaneously moves cooling air:

into contact with said front face of said inductor;

through said center opening of said inductor; and around said outer edge of said inductor, wherein said mounting hardware, said clamp element, and the mounting surface combined contact less than ten percent of said surface area of said inductor allowing contact of said cooling air with at least ninety percent of said surface area of said inductor.

8. The inductor mount of claim 7, wherein said clamp element protrudes through said inductor, wherein said clamp element comprises a first end proximate said front face of said inductor, wherein said clamp element comprises a second end proximate said hack face of said inductor, wherein said mounting hardware connects said first end of said clamp element to the mounting surface, and wherein said mounting hardware connects said second end of said clamp element to the mounting surface.

9. The inductor mount of claim 7, further comprising a first shock absorbing element compressed between said clamp element and said inner surface of said inductor.

10. The inductor mount of claim 9, further comprising a second shock absorbing element compressed between said outer edge of said inductor and the mounting surface.

11. The inductor mount of claim 7, wherein said mounting hardware comprises a first non-conducting surface in proximate contact with said front face of said inductor, and wherein the mounting surface comprises a non-conducting material.

12. The inductor mount of claim 11, wherein said mounting hardware comprises a second non-conducting surface in proximate contact with said hack face of said inductor.

13. The inductor mount of claim 12, wherein said mounting hardware comprises a non-conducting hollow rod shielding a connecting element, wherein said non-conducting hollow rod comprises a material heat resistant to at least one hundred fifty degrees Celsius, wherein a metal connecting element fits through said non-conducting hollow rod, wherein said metal connecting element fastens said clamp element to the mounting surface.

14. The inductor mount of claim 12, wherein the mounting surface comprises an about horizontal surface.

15. The inductor mount of claim 12, wherein the mounting surface comprises an about vertical surface.

16. The inductor mount of claim 7, wherein there exists at least one mounting surface for each of a plurality of mounting elements, wherein each of said plurality of mounting elements edge mount at least one inductor, and further comprising a base plate, wherein said base plate affixes with said plurality of mounting elements.

17. The inductor mount of claim 16, wherein said base plate comprises a pedestal, wherein said pedestal edge mounts a plurality of inductors at different vertical heights.

18. The inductor mount of claim 17, wherein said inductor comprises a substantially annular core, wherein said substantially annular core comprises a core material, said core material comprising an equally distributed gap at a particulate scale throughout said mass of said substantially annular core, said inductor further comprising:

a conductor substantially contacting said substantially annular core, wherein said inductor operates at current levels in excess of about one hundred amperes, wherein said inductor exhibits a permeability of less than thirteen delta Gauss per delta Oersted at a load of four hundred Oersteds, wherein, during use, a period of alternating current flowing through said inductor is present at greater than about five hundred Hertz.

19. The inductor mount of claim 18, said substantially annular core comprising:

a pressed powder alloy comprising iron powder and a bonding agent, wherein said iron powder and said bonding agent comprise a substantially even distribution through said mass of said core.

* * * * *